US009457485B2

(12) United States Patent
Pohl et al.

(10) Patent No.: US 9,457,485 B2
(45) Date of Patent: Oct. 4, 2016

(54) ELECTRIC SHAVER COMPRISING A PIVOTABLE SHAVING HEAD

(71) Applicant: Braun GmbH, Cincinnati, OH (US)

(72) Inventors: Thorsten Pohl, Kronberg (DE); Joachim Krauss, Kronberg (DE); Tobias Schwarz, Kronberg (DE); Peter Junk, Kronberg (DE); Reinhold Eichhorn, Kronberg (DE); Andreas Peter, Kronberg (DE); Michael Odemer, Kronberg (DE); Martin Fuellgrabe, Kronberg (DE); Christoph Zegula, Kronberg (DE); Alois Koeppl, Kronberg (DE)

(73) Assignee: Braun GmbH, Kronberg (DE)

( * ) Notice: Subject to any disclaimer, the term of this patent is extended or adjusted under 35 U.S.C. 154(b) by 590 days.

(21) Appl. No.: 13/671,601

(22) Filed: Nov. 8, 2012

(65) Prior Publication Data

US 2013/0111759 A1 May 9, 2013

(30) Foreign Application Priority Data

Nov. 8, 2011 (EP) ..... 11188233

(51) Int. Cl.

| | |
|---|---|
| ***B26B 19/38*** | (2006.01) |
| ***B26B 19/04*** | (2006.01) |
| ***B26B 19/06*** | (2006.01) |

(52) U.S. Cl.

CPC ..... *B26B 19/38* (2013.01); *B26B 19/048* (2013.01); *B26B 19/063* (2013.01); *B26B 19/382* (2013.01); *B26B 19/386* (2013.01)

(58) Field of Classification Search

CPC ..... B26B 19/10; B26B 19/102; B26B 19/38; B26B 19/382; B26B 19/386

USPC ..... 30/531, 34.1, 43.1, 43.91, 43.92, 42, 30/44, 45

See application file for complete search history.

(56) References Cited

U.S. PATENT DOCUMENTS

| | | | | | |
|---|---|---|---|---|---|
| 576,862 | A | * | 2/1897 | Lebold | 30/531 |
| 831,259 | A | * | 9/1906 | Bingler | 30/531 |
| 929,015 | A | * | 7/1909 | Reed | 30/531 |
| 973,734 | A | * | 10/1910 | Young | 30/531 |
| 991,998 | A | * | 5/1911 | Jones | 30/531 |
| 1,247,581 | A | * | 11/1917 | Seitz | 30/531 |
| RE14,748 | E | * | 11/1919 | Goodwin | 30/531 |
| 1,327,547 | A | * | 1/1920 | Goodwin | 30/531 |
| 1,693,348 | A | * | 11/1928 | Pollifrone | 30/531 |
| 1,796,260 | A | * | 3/1931 | Gaisman | 30/531 |
| 1,999,200 | A | * | 4/1935 | Nagy | 30/531 |
| 2,001,198 | A | * | 5/1935 | Klegman | 30/531 |
| 2,008,590 | A | * | 7/1935 | Ohmer | 30/531 |
| 2,077,241 | A | * | 4/1937 | Karle | 30/531 |
| 2,107,358 | A | * | 2/1938 | Aghito | 30/531 |
| 2,119,792 | A | * | 6/1938 | Parkin | 30/531 |

(Continued)

FOREIGN PATENT DOCUMENTS

| | | | |
|---|---|---|---|
| EP | 2591889 | A1 * | 5/2013 |
| JP | 52-78564 | | 7/1977 |
| WO | WO 2013068926 | A1 * | 5/2013 |

*Primary Examiner* — Jason Daniel Prone

(74) *Attorney, Agent, or Firm* — Ronald T. Sia; Kevin C. Johnson; Steven W. Miller

(57) ABSTRACT

The invention relates to an electric shaver having a housing pivotably connected to a shaving head, where the shaving head can be locked at several predetermined positions.

9 Claims, 5 Drawing Sheets

(56) References Cited

U.S. PATENT DOCUMENTS

| | | | | | |
|---|---|---|---|---|---|
| 2,325,868 | A | * | 8/1943 | Morrow | 30/531 |
| 2,709,297 | A | * | 5/1955 | Mikles | 30/531 |
| 2,709,850 | A | * | 6/1955 | Randol | 30/531 |
| 2,709,851 | A | * | 6/1955 | Randol | 30/531 |
| 2,710,447 | A | * | 6/1955 | Borden | 30/531 |
| 2,744,317 | A | * | 5/1956 | Borden | 30/531 |
| 2,748,470 | A | * | 6/1956 | Borden | 30/531 |
| 2,780,866 | A | * | 2/1957 | Borden | 30/531 |
| 3,797,109 | A | | 3/1974 | Yamada et al. | |
| 3,964,160 | A | * | 6/1976 | Gordon | 30/531 |
| 4,114,264 | A | * | 9/1978 | Buchholz | 30/34.1 |
| 4,505,036 | A | * | 3/1985 | Ochiai et al. | 30/34.1 |
| 4,649,642 | A | * | 3/1987 | Nagasaki et al. | 30/34.1 |
| 4,922,608 | A | * | 5/1990 | Pahl | 30/43.91 |
| 4,930,217 | A | | 6/1990 | Wolf et al. | |
| 5,233,746 | A | * | 8/1993 | Heintke | 30/531 |
| 5,235,749 | A | * | 8/1993 | Hildebrand et al. | 30/43.92 |
| 5,245,754 | A | * | 9/1993 | Heintke et al. | 30/43.92 |
| 5,257,456 | A | * | 11/1993 | Franke et al. | 30/43.92 |
| 5,289,636 | A | * | 3/1994 | Eichhorn et al. | 30/43.92 |
| 5,313,704 | A | * | 5/1994 | Atsumi et al. | 30/531 |
| 5,343,621 | A | * | 9/1994 | Hildebrand et al. | 30/43.92 |
| 5,410,811 | A | * | 5/1995 | Wolf et al. | 30/43.92 |
| 5,507,095 | A | * | 4/1996 | Wetzel et al. | 30/34.1 |
| 5,524,345 | A | * | 6/1996 | Eichhorn | 30/34.1 |
| 5,542,179 | A | | 8/1996 | Beutel | |
| 6,205,666 | B1 | * | 3/2001 | Junk | 30/43.92 |
| 6,481,103 | B2 | * | 11/2002 | Van Hout et al. | 30/34.1 |
| 6,502,312 | B2 | * | 1/2003 | Beutel et al. | 30/34.1 |
| 7,490,408 | B2 | * | 2/2009 | Eichhorn et al. | 30/34.1 |
| 7,503,118 | B2 | * | 3/2009 | Oh | 30/43.4 |
| 7,707,725 | B2 | * | 5/2010 | Eichhorn et al. | 30/34.1 |
| 8,112,892 | B2 | * | 2/2012 | Haczek et al. | 30/50 |
| 8,127,453 | B2 | * | 3/2012 | Haczek et al. | 30/43.92 |
| 8,661,688 | B2 | | 3/2014 | Shigeta et al. | |

* cited by examiner

ELECTRIC SHAVER COMPRISING A PIVOTABLE SHAVING HEAD

FIELD OF THE INVENTION

The invention relates to an electric shaver.

BACKGROUND OF THE INVENTION

Electric shavers of the type initially referred to are known for example from the U.S. Pat. No. 3,797,105. This document discloses an electric dry shaver having a handle and a shaving head pivotably connected to that handle. The shaving head comprises a shaving element of the rotary type and its driving motor. The handle is adapted to carry the batteries and comprises a pair of arms extending from the handle to bear the rockable shaving head. Between the shaving head and the arms clicking means are provided to lock the head at predetermined rocked angles. Due to those clicking means the shaving head itself is never completely freely pivotable relative to the handle.

An electric shaver which comprises a shaving head being freely pivotable connected to the housing of the shaver is known from the U.S. Pat. No. 5,542,179. The advantage of such an electric shaver is that the shaving head is able to adapt perfectly to the contour of the skin to be shaved. However, sometimes, for example when shaving under the nose, there is a need to fix the shaving head relative to the housing at least temporarily.

SUMMARY OF THE INVENTION

It is therefore an objective of the present invention to overcome all the drawbacks of the known shaving systems especially such as discussed above and to provide an improved electric shaver of the type initially referred to such to ensure an optimal handling of the shaver in any shaving situation.

The electric shaver according to the invention enables a fixing of the shaving head relative to the housing if needed whereby the fixing can take place at a multitude of different predetermined angles.

The electric shaver according to the invention comprises a housing and a shaving head being pivotably connected to the housing. The shaving head comprises at least one cutting element for cutting hairs. The shaver further comprises means for locking the pivoting motion of the shaver head at several predetermined positions, whereby the shaving head comprises a multitude of notches to be coupled with an engaging element, whereby the engaging element is connected to a switch element which is provided at the housing. This improves the handling of the shaver during the shaving process and leverages the shaving comfort. Whenever needed, the user of the electric shaver is enabled by simply actuating the switch element to lock the shaving head in one of a multitude of possible locking angles by keeping the shaver rested in the user's hand.

Preferably, the switch element is apt to be switched into at least a coupled state or in a decoupled state for the shaving head.

In a preferred embodiment of the invention, the engaging element provides a preloaded connection with the shaving head in case the engaging element is switched in the coupled state. The engaging element preferably comprises a spring element.

Another preferred embodiment of the invention is characterized in that the switch element is connected to the engaging element via a pivoted lever. Preferably, the pivot bearing of this pivoted lever is arranged at the housing of the shaver. To avoid that the shaving apparatus is top heavy but is rather balanced with respect to the distribution of the weight, it is preferred that the electric motor for driving the cutting system(s) of the shaving head is located in the housing.

Often there is a wish to integrate an additional tool in the electric shaver which contacts the skin during its application, for example an additional cutting system or an applicator for fluid or the like. Therefore, a preferred embodiment of the invention comprises a slider which is slidably arranged at the housing in a way that its upper end can get into the pivoting range of the shaving head. To avoid an interference of the slider and the rockable shaving head, a mechanical actuating element is provided to displace the shaving head and daff it aside in order to allow the slider to travel into the direction of its upper end. Preferably, the mechanical actuation element is an operating lever whose pivot bearing is arranged at the housing. To realize this embodiment without a huge mechanical effort the shaving head provides an outer stop to be charged by the actuating lever.

Preferably there is an additional cutting system arranged at the top of the slider, especially it is constructed as a long-hair trimmer.

BRIEF DESCRIPTION OF THE DRAWINGS

The invention will be further elucidated by detailed explanation of exemplary embodiments and by reference to the figures. In the figures

DETAILED DESCRIPTION OF THE INVENTION

Figure 2:
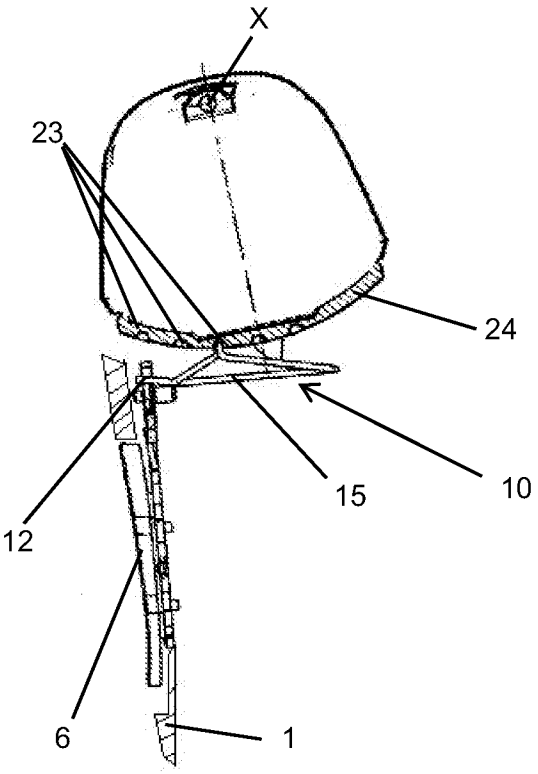
FIG. 2 is a side view of the shaving head and the locking mechanism.
Figure 1:
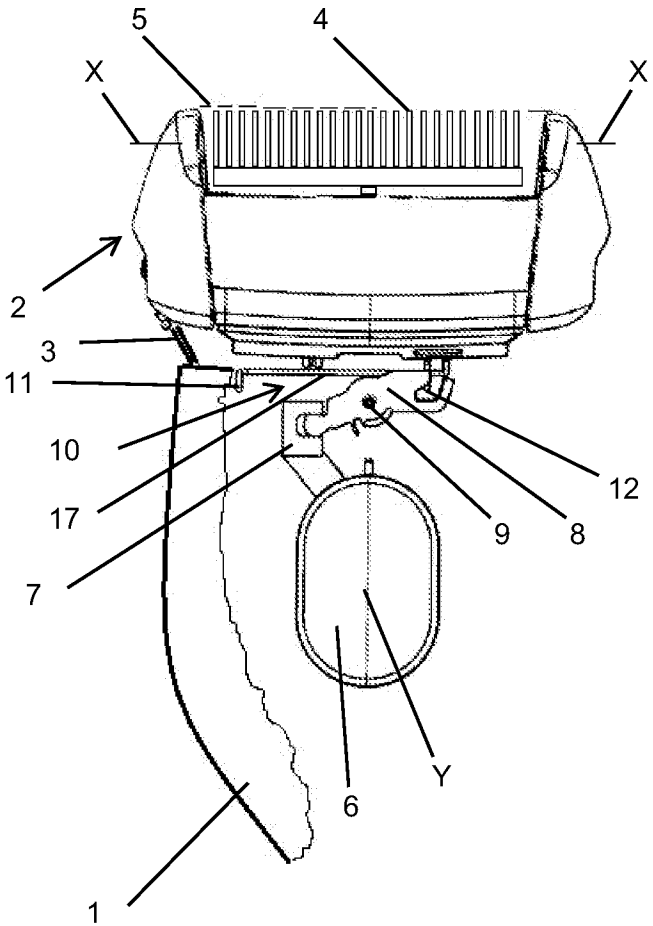
FIG. 1 is an illustration of a front view of an electric shaver according to the invention.
Figure 3:
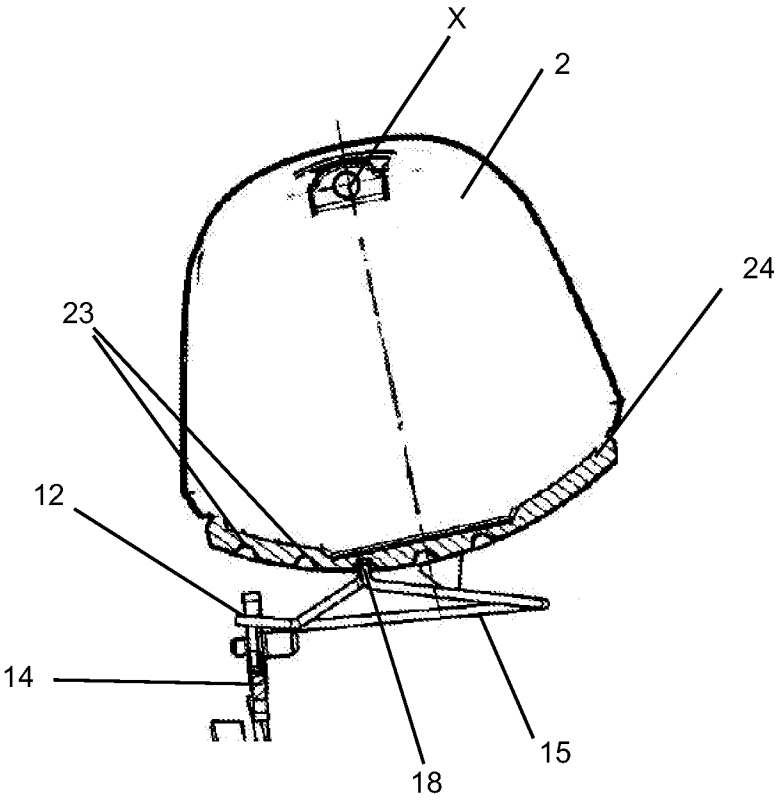
FIG. 3 is an enlarged view of the shaving head in the locked position.

FIG. 1 shows an illustration of an electric shaver having a housing 1 and a shaving head 2 which is connected via bearing arms 3 with the housing in a manner so that it is able to pivot around the lateral axis x. The shaving head 2 encompasses cutting systems having an inner cutter 4 and an outer cutter 5. This kind of features is known in general for example from the U.S. Pat. No. 5,542,179. A housing 1 accommodates the electric motor (not shown) for driving the undercutter 4 which is coupled to the electric motor in a known manner. Housing 1 further encompasses the batteries (not shown) for energizing the electric motor. FIG. 1 shows a switch element 6 which is slidably mounted on the front side of the housing 1 and adapted to be moved along the vertical axis y. In FIGS. 1 and 2, the switch element 6 is shown in its lower (locking) position. Switch element 6 comprises a catch 7 for the left one of the two free ends of a pivoting lever 8 which is connected to the housing 1 via a pivot bearing 9. The right free end of the pivoting lever 8 is constructed to control the free end 12 of the engaging element 10. The engaging element 10 comprises further a fixed end 11 which is clamped at the housing 1. The engaging element 10 is generally constructed as a beam in bending having, according to FIGS. 3 and 4, a fixed end 11 clamped to the housing and a free end 12 which is controlled by the pivoting lever 8 and guided via a cam 13 of a guidance plate 14 (see FIGS. 5 to 8).

As can be taken best from the FIGS. 1 to 4, the engaging element 10 is shaped essentially as a squared U with a first arm 15 providing a fixed end 11, a middle section 17 and a second arm 16 which provides the free end 12. Seen from the front according to FIG. 1 the fixed end 11 is located to the left of the pivoting lever 8 whereby its first arm 15 extends to the back of the housing where the spring wire, of which the engaging element 10 is made of, is bent to the right hand side where it leads as a middle section 17 to the right. The middle section 17 is arranged in parallel to the back of the housing. At the right end of the middle section 17, there is a rectangular curve followed by the second arm 16 which is directed to the front of the housing. The second arm 16 provides a hump-like protuberance 18 located approximately in the middle of the second arm 16. The protuberance 18 divides the second arm 16 into two parts whereby each of the two parts is inclined upwardly into the direction of the protuberance 18.

At its free end 12 the second arm 16 of the engaging element 10 is guided through the cam 13 of the guidance plate 14. The second arm 16 is projecting with its free end 12 to the outside of the guidance plate 14 and is acted upon by the pivoting lever 8.

Figure 5:
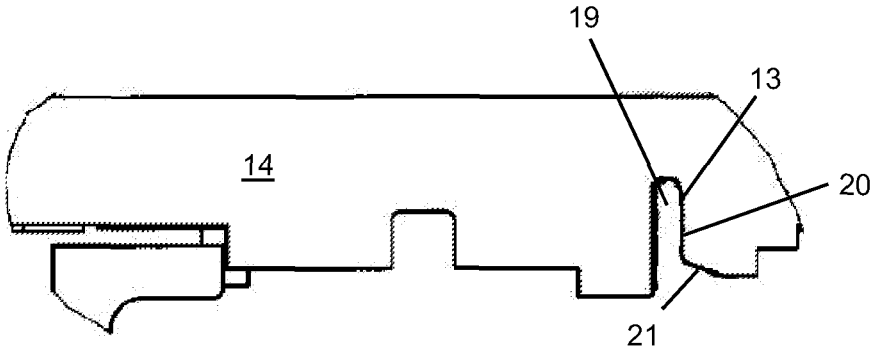

The guidance plate 14 is shown in FIG. 5. It comprises a vertical slot 19. The width of the slot 19 is a little bit broader than the diameter of the second arm 16. Vertical slot 19 includes a vertical section 20. The guidance plate 4 also includes an inclined section 21 connected to the vertical section 20. The vertical section 20 and inclined section 21 form the cam 13.

Figure 4:
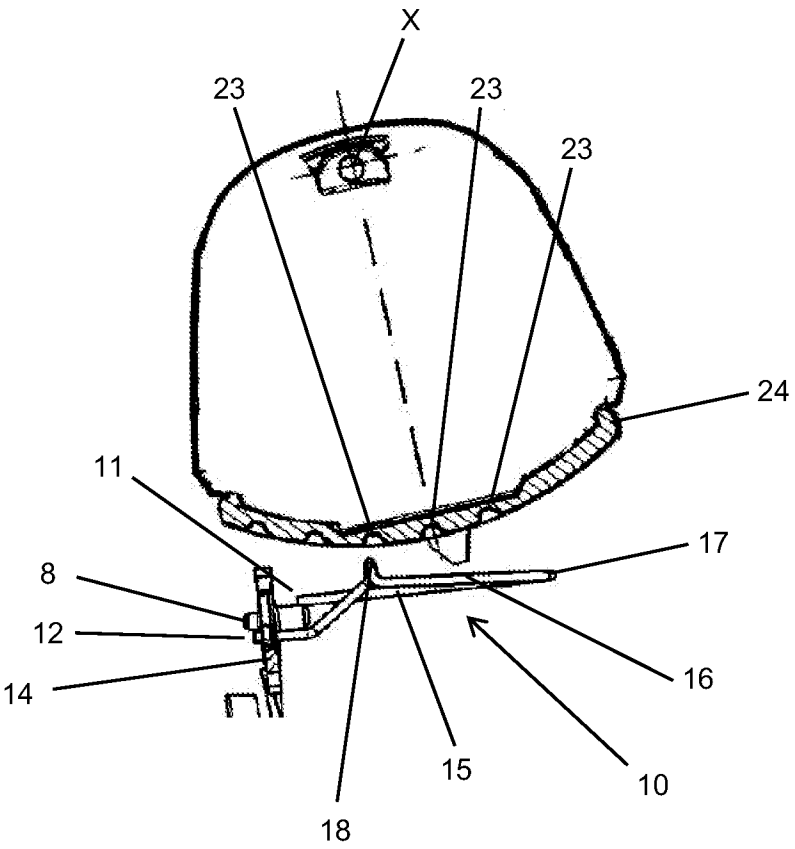
FIG. 4 is a side view of the shaver in an unlocked position of the locking mechanism, FIG. 5 to FIG. 8 is an illustration of the pivoted lever according to the invention in different positions.
Figure 6:
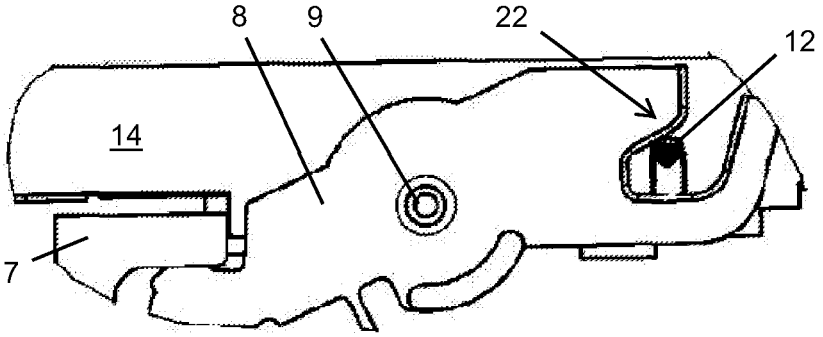
Figure 7:
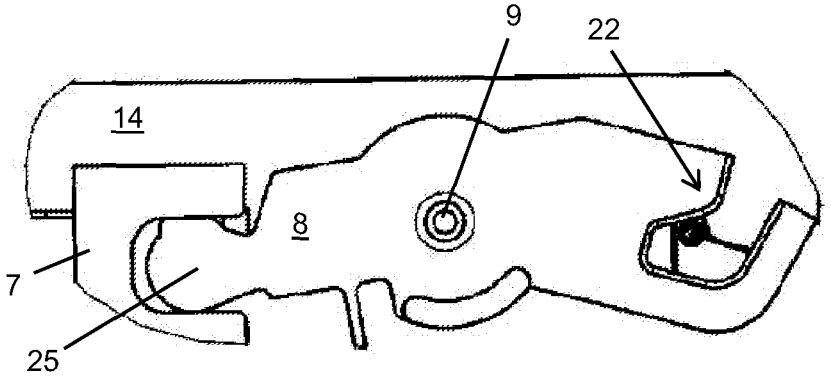
Figure 8:
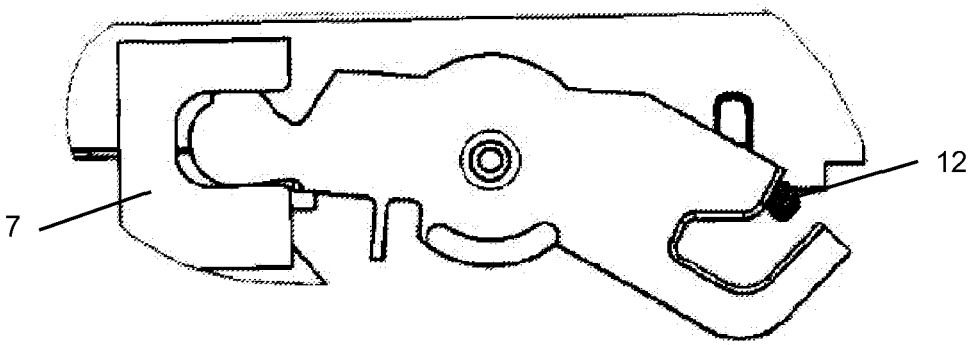

In FIGS. 1 to 3 and 6, the pivoting lever 8 is shown in a position where the switch element 6 is in its downward lock position and the shaving head 2 is locked, i.e., movably locked, via the protuberance 18 of the engaging element 10. The engaging element 10 is preloaded in a way that its second arm 16 is biased upwardly into the direction of the shaving head 2. Consequently the free end 12 of the second arm 16 rests on the upper end of the vertical slot 19 if unaffected by the pivoting lever 8 via its convex cam section 22. This position is illustrated in FIG. 6. As can be taken best from FIG. 3 in this position—unaffected by the pivoting lever 8—the protuberance 18 is pressed into one of the apertures 23 provided in the bottom 24 of the shaving head 2. The bottom 24 is curved with a radius which equals the distance between axis X and the bottom 24. The apertures are essentially V-shaped having a rounded ground. The pressing force of the protuberance 18 into the apertures 23 due to the elastical preload of the second arm 16 is about 4 N. Predetermined by this value of the pressing force and the angle of the flanks as well as the distance between the lateral axis X and the bottom 24 it is possible to override the locking force with a pivoting force of about 6 N if applied circumferentially at the bottom 24. This means that even if the shaving head 2 is "locked" it can be pivoted if the pivoting force is high enough which means that in this situation the engaging element has the function of a clicking mechanism whereby the user can override the locking force by applying a tangential force which exceeds a certain value (6 N). This force is predetermined at a value which is higher than the pivoting forces which occur during the normal shaving process. FIGS. 4 and 8 are depicting the unlocked state of the shaving head 2 where the switch element 6 is in its upward end position. The transition from the locked position as shown in FIG. 6 to the unlocked position is illustrated in FIGS. 6 to 8. Starting from FIG. 6, the pivoting lever 8 is turned clockwise around the pivot bearing 9 via the catch 7 which is connected to the switch element 6. The bracket type catch 7 is receiving the spherical end portion 25 of the pivoting lever 8 which is at the left-hand side of the pivoting lever 8, as illustrated in FIGS. 6 to 8. When moving the switch element 6 upwardly and consequently starting turning the pivoting lever 8 clockwise, the convex cam section 22 located at the right side end of the pivoting lever 8 is pressing down the free end 12 of the second arm 16 of the engaging element 10 vertically along the vertical slot 19. When the free end 12 has reached the end of the vertical section 20 of the slot where the inclined section 21 starts—this is illustrated in FIG. 7—the free end 12 follows the inclined section 21 and is pushed to the right side following the inclined section 21 as well as the convex cam section 22. The end position of this rotation of the pivoting lever 8 when also the switch element has reached its upper end position is illustrated in FIG. 8. When the free end 12 has reached its end position according to FIG. 8, the biasing force of the engaging element is essentially received by the guidance plate 14. The pivoting lever 8 is nearly released from this biasing force. It should be noted that the switch 6 may provide a detent which enables a snapping to the housing 1 in its end positions.

Figure 10:
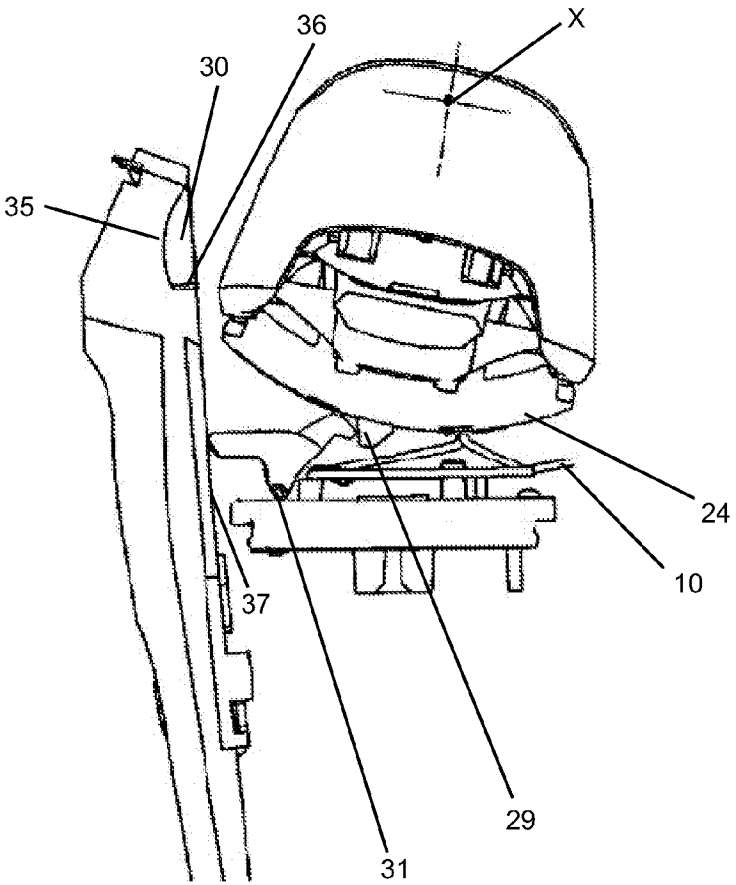
FIG. 9 and FIG. 10 are side views of the electric shaver having a slider which is shown in different positions.
Figure 9:
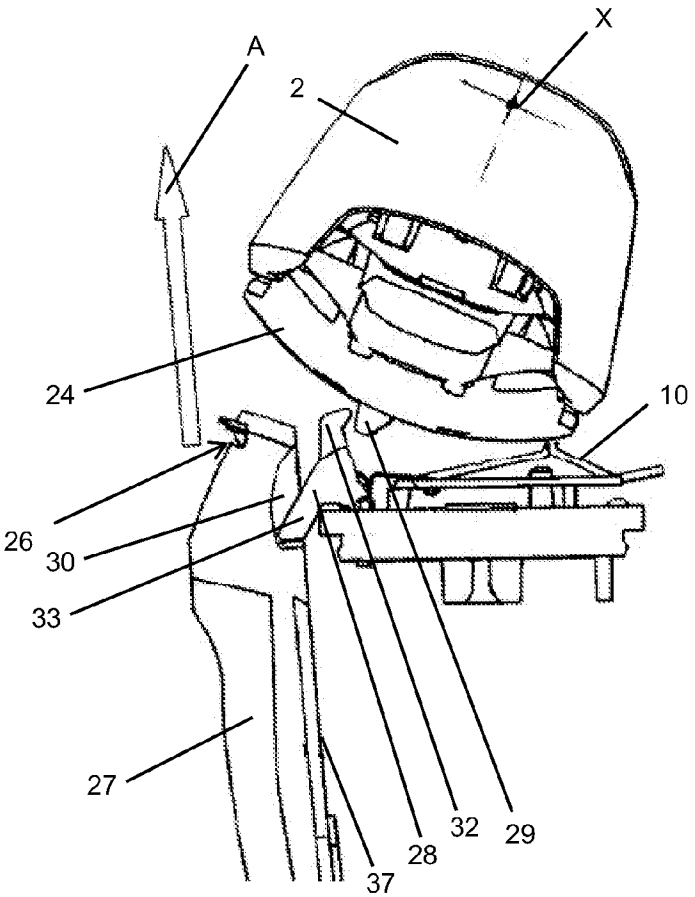
Figure 12:
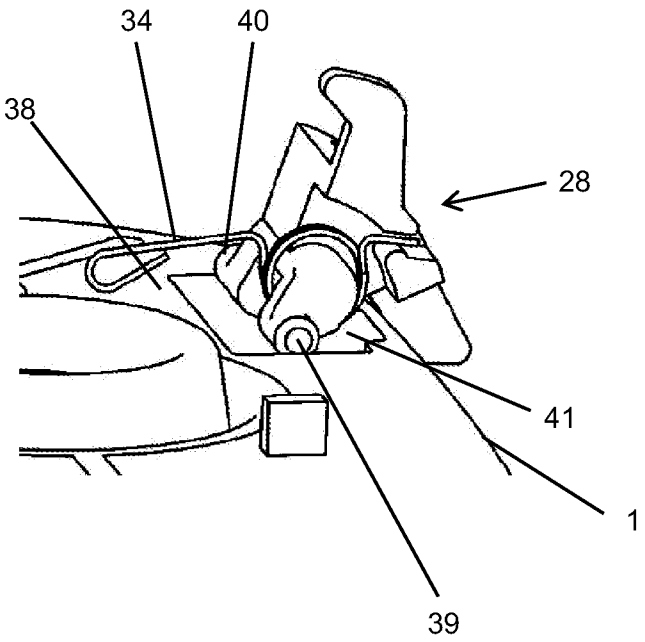
FIG. 12 is an enlarged view of the operating lever.

FIGS. 9 and 10 are showing a version of an electric shaver which provides an additional long-hair trimmer 26 which is arranged at the back of the housing 1. The long-hair trimmer 26 is located at the top of a slider 27 which is slidably born on the housing 1. It becomes evident from FIG. 9 that in case of a linear movement of the slider 27 in the direction of the arrow A collision of the long-hair trimmer 26 and the shaving head 2 could occur if the shaving head 2 is pivoted clockwise above a certain angle since the areas of movement of the slider 27 and of the shaving head 2 are overlapping. To avoid this collision the following mechanism is provided. In one embodiment, the mechanical actuating element for displace the shaving head comprises an operating lever 28 is connected via a pivot bearing 31 at the top end 38 of the housing 1. The operating lever 28 has a first end 32 and a second end 33. When the slider 27 is in its retracted parking position as shown in FIG. 9, the second end 33 of the operating lever 28 rests in the catch 30 which is provided on the inner side of the slider 27. The operating lever 28 is elastically preloaded by a wound spring 34, which spring is illustrated in the FIGS. 11 and 12. According to the view of FIG. 9, the spring 34 is biasing the operating lever 28 counter-clockwise. As can be taken best from FIG. 10, the catch 30 provides a concave contour 35 and a stop 36 which is essentially perpendicular to the vertical extension of the slider 27. The bottom 24 of the shaving head 2 provides a stop 29 which interacts with the first end 32 of the operating lever 28.

When starting from the position as shown in FIG. 9, the slider 27 is moved upwardly according to the arrow A and the stop 36 of the catch 30 turns the operating lever 28 clockwise around the pivot bearing 31. In case the shaving head 2 is swung out to the right (clockwise around the lateral axis X), the first end 32 of the operating lever 28 acts upon the outer stop 29 to rotate the shaving head counter-clockwise to clear the travel of the slider 27. Hereby the operating lever 28 is turned against the preload of the spring 34. After a certain distance of travelling of the slider 27 the operating lever 28 is completely swung out into the position shown in FIG. 10. At that point of travel of the slider 27, the second end 33 of the operating lever is acted upon by the support area 37 which holds the operating lever in the position as shown in FIG. 10. In this position the drive chain of the long-hair trimmer 26 is coupled in a generally known way to the electric motor (not shown) and the respective cutting element of the long-hair trimmer 26 are driven in a known way.

When—starting from the extracted position as shown in FIG. 10—the slider 27 is drawn back into its parking position, the long-hair trimmer 26 is decoupled from the electric motor and the operating lever 28 remains in the position as shown in FIG. 10 since the support area 37 acts upon the second end 33 of the operating lever 28. If the upper end of the support area 37 reaches the second end 33 of the operating lever 28 at the stop 36, the operating lever 28 is pivoted counter-clockwise into the position as shown in FIG. 9. This counter-clockwise rotation is forced by the spring 34. In this parking position the shaving head 2 is free to pivot around the lateral axis X. The relationship of the two levers of the operating lever 28 are chosen in a way that the shaving head 2 can be pushed away counter-clockwise even if the engaging element 10 is in its locked position.

In case the shaving head 2 is completely blocked, for example manually by the user of the shaver, the following will happen when the slider 27 is moved upwardly into an extracted position as shown in FIG. 10. As can be taken from FIG. 12, the pivot bearing 31 is carried out by two pins 39 and 40 which are supported in a recess 41 which is provided at the top end 38 of the housing 1. The spring 34 does not only provide the restoring torque for the operating lever 28 as explained for the FIGS. 9 and 10 but additionally provides a biasing force to the operating lever into the downward direction. Therefore, the pins 39 and 40 are pressed in the direction of the recess 41.

Figure 11:
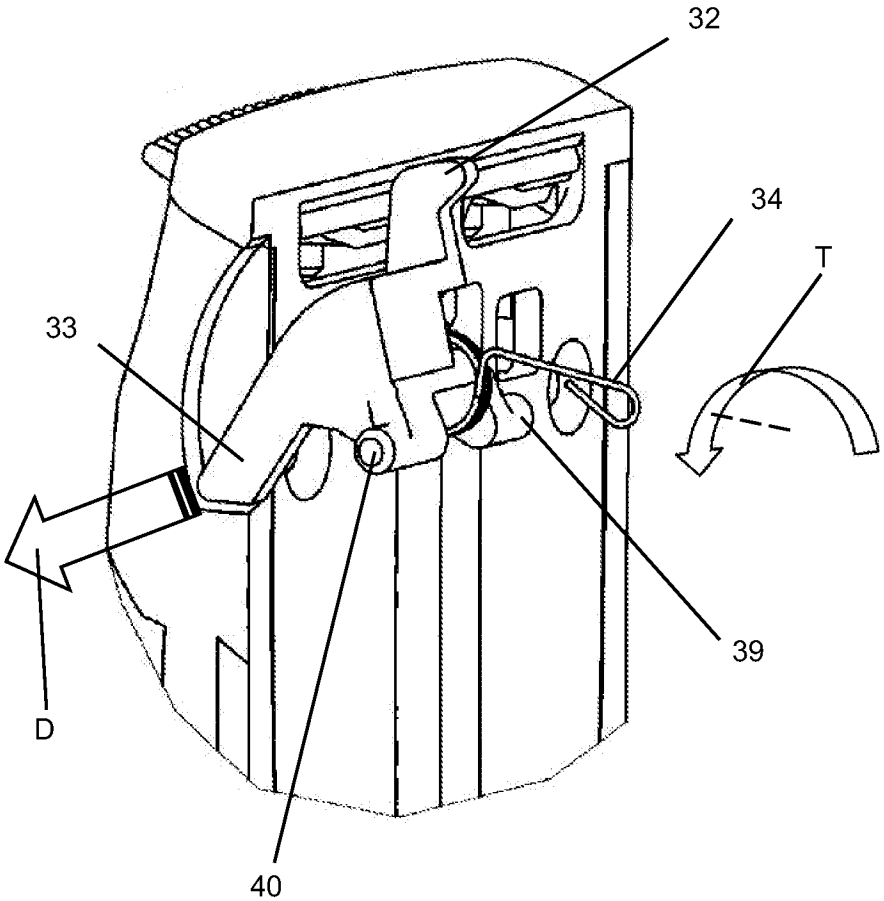
FIG. 11 is a perspective view of the slider, the long-hair trimmer and the operating lever.

As shown in FIG. 11, the spring 34 additionally provides a torque moment T in counter-clockwise direction.

If now, as mentioned before in a blocked system (completely blocked shaving head 2), an overload occurs when the slider 27 is shifted upwardly, the operating lever 28 can be rotated against the torque moment T so that the second end 33 of the operating lever 28 is moving laterally away from the catch 30 into the direction of the arrow D. The slider 27 can then be moved upwardly until it contacts the bottom 24 of the shaving head 2. If the slider 27 is then moved back again into its retracted parking position, the second end 33 is pushed back into the catch 30 by the biasing torque T.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An electric shaver comprising:

a housing having at least one engaging element, a pivot lever, and a switch element disposed on the housing;

a shaving head pivotably connected to the housing, the shaving head having at least one cutting system and a plurality of apertures formed along a bottom of the shaving head;

the at least one engaging element constructed to engage one of the plurality of apertures;

the pivot lever having a first end and a second end, the second end connected to the at least one engaging element; and the switch element connected to the first end of the pivot lever, the switch element constructed to move in at least a first position and a second position, wherein when the switch element is moved to the first position it moves the at least one engaging element into one of the plurality of apertures, locking the shaving head into a fixed position relative to the housing; and wherein when the switch element is moved to the second position it moves the at least one engaging element from one of the plurality of apertures, thus permitting the shaving head to pivot relative to the housing.

2. The electric shaver as claimed in claim 1, wherein the engaging element comprises a spring element biasing the engagement element toward the bottom of the shaving head.

3. The electric shaver as claimed in claim 1, wherein the pivoted lever is engaged to the housing about a pivot bearing.

4. The electric shaver as claimed in claim 1, further comprising an operating lever connected to the housing;

wherein the shaving head comprises a stop extending from the bottom;

wherein the housing comprises a slider having an upper end and is slidably arranged to the housing such that the upper end is slidable toward the shaving head; and wherein when the slider slides toward the shaving head, the slider engages the operating lever such that the operating lever engages the stop and pivots the shaving head toward the slider.

5. The electric shaver as claimed in claim 4, wherein the operating lever is connected to the housing with a pivot bearing.

6. The electric shaver as claimed in claim 5, wherein an additional cutting system is arranged at the top end of the slider.

7. The electric shaver as claimed in claim 4, wherein an additional cutting system is arranged at the top end of the slider.

8. The electric shaver as claimed in claim 7, wherein the additional cutting system is a long-hair trimmer.

9. The electric shaver as claimed in claim 6, wherein the additional cutting system is a long-hair trimmer.

* * * * *